US006216365B1

(12) United States Patent
Cohen

(10) Patent No.: US 6,216,365 B1
(45) Date of Patent: Apr. 17, 2001

(54) SHOCK-ABSORBING INSOLE

(75) Inventor: Abraham Cohen, Carmiel (IL)

(73) Assignee: Springco, Ltd., Ramat-Gan (IL)

( * ) Notice: Subject to any disclaimer, the term of this patent is extended or adjusted under 35 U.S.C. 154(b) by 0 days.

(21) Appl. No.: 09/433,749

(22) Filed: Nov. 4, 1999

(30) Foreign Application Priority Data

Nov. 5, 1998 (IL) ..... 126916

(51) Int. Cl.[7] ..... A43B 13/38; A43B 13/28; A43B 13/18; A43B 21/26; A43B 21/30

(52) U.S. Cl. ..... 36/44; 36/102; 36/27; 36/28; 36/35 R; 36/38

(58) Field of Search ..... 36/43, 44, 92, 36/102, 132, 27, 28, 35 R, 37, 38, 179, 35 B, 36 R

(56) References Cited

U.S. PATENT DOCUMENTS

Re. 13,150 * 9/1910 Byrne ..... 36/37
4,356,642 * 11/1982 Herman ..... 36/44
5,185,943 * 2/1993 Tong et al. ..... 36/28
5,224,277 * 7/1993 Sang Do ..... 36/27
5,311,674 * 5/1994 Santiyanont et al. ..... 36/28
5,544,431 * 8/1996 Dixon ..... 36/27
5,649,374 * 7/1997 Chou ..... 36/27
5,839,209 * 11/1998 Healy et al. ..... 36/27
5,918,383 * 7/1999 Chee ..... 36/28
5,983,529 * 11/1999 Serna ..... 36/28
6,006,449 * 12/1999 Orlowski et al. ..... 36/27
6,055,747 * 5/2000 Lombardino ..... 36/37

* cited by examiner

*Primary Examiner*—Paul T. Sewell
*Assistant Examiner*—Anthony Stashick
(74) *Attorney, Agent, or Firm*—Oblon, Spivak, McClelland, Maier & Neustadt, P.C.

(57) ABSTRACT

A shock-absorbing insole for footwear, including a top member adapted to be in contact with the user's foot; a bottom member partly connected to the top member and adapted to rest on the inside sole of a piece of footwear, and defining a space with a heel portion of the top member, and a shock-absorbing unit including, in superposition, a top plate, at least one rubber pad and at least one effective member provided with a plurality of elastically deformable elements, the at least one rubber pad and the at least one effective member forming a cohesive packet which is introducible into the space via a window-like opening in a rim portion of the bottom member.

7 Claims, 4 Drawing Sheets

SHOCK-ABSORBING INSOLE

FIELD OF THE INVENTION

The present invention relates to a shock-absorbing insole for footwear.

BACKGROUND OF THE INVENTION

The term "insole" as used herein is to be understood as referring to an inside sole of a shoe, particularly to a relatively thin insert introducible into a shoe and serving mainly for foot comfort.

The deleterious effect on the skeletal system, especially on the heel, the knee joint and the vertebral column, of repeated impact occasioned by running, jumping or even brisk walking, is well-known, with many attempts having been made to design special shoes or boots having built-in shock-absorbing members intended to alleviate this problem. Other attempts, such as described, for example, in U.S. Pat. No. 5,042,175, provide both integral, ie., built-in, and insole solutions. This U.S. patent proposes a sole (or an insole) containing a relatively large number of cylindrical compression springs, confined between a lower part of the sole or insole provided with a plurality of recesses nesting one end of these springs, and an upper cover strip removably attachable to the lower part.

The disadvantages of the above and similar soles or insoles resides largely in the fact that they all use cylindrical springs, the 'solid' height of which, in other words, their height when compressed to the point where their turns rest on one another, is irreducible. As a consequence, in order to present a reasonable 'working stroke,' the free, uncompressed length of such springs must be relatively large, causing such soles to be rather thick and cumbersome. With insoles that are intended for use with standard footwear, this problem is even more serious, as their thickness is liable to seriously reduce the free space of the shoe or boot.

SUMMARY OF THE INVENTION

It is thus one of the objects of the present invention to provide an insole that, for a given shock-absorbing capacity, requires a significantly smaller insole thickness than that of the prior art insoles.

It is a further object of the present invention to provide an insole that can be customized to take into account the relevant physical characteristics of the wearer, such as his weight and possible special orthopedic problems, as well as the principal uses of the footwear for which the insoles are intended, such as walking, marching, jogging, running, etc.

According to the invention, the above objects are achieved by providing a shock-absorbing insole for footwear, comprising a top member adapted to be in contact with the user's foot; a bottom member partly connected to said top member and adapted to rest on the inside sole of a piece of footwear, and defining a space with a heel portion of said top member, and a shock-absorbing unit comprising a top plate, at least one rubber pad and at least one effective member provided with a plurality of elastically deformable elements, characterized in that said top plate, said at least one rubber pad and said at least one effective member form a cohesive packet which is introducible into said pace via a window-like opening in a rim portion of said bottom member.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is an elevational view of the assembled insole according to the present invention;

FIG. 2 is a perspective view of the assembled insole;

FIG. 3 shows the bottom insole member as seen in a direction towards its heel portion;

FIG. 4 is an exploded view of a preferred embodiment of the insole according to the invention;

FIG. 5 is a cross-sectional view of the assembled insole as shown in the exploded view of FIG. 4;

FIG. 6 is a top view of a first embodiment of the effective member of the shock-absorbing unit;

FIG. 7 is a view of the member of FIG. 6 as seen in the direction of arrow A in FIG. 6;

FIG. 8 represents the effective member of FIG. 6 as seen in the direction of arrow B in FIG. 7;

FIG. 9 is a top view of a blank of a second embodiment of the effective member of the shock-absorbing unit;

FIG. 10 is a view of the member of FIG. 9, as seen in the direction of arrow C in FIG. 9, and FIG. 11 represents a more slender insole for elegant shoes, having only one effective member.

DESCRIPTION OF PREFERRED EMBODIMENTS

Figure 1:
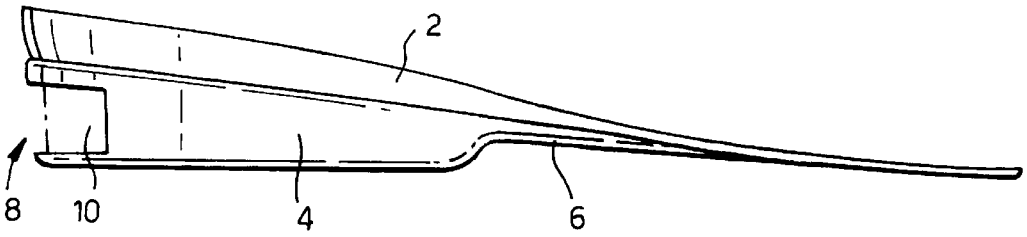
Figure 2:
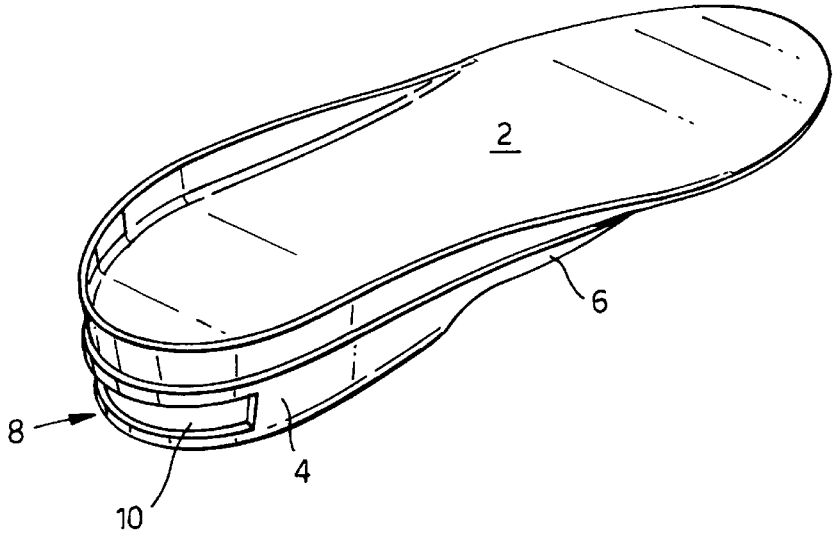

Referring now to the drawings, there is represented in FIGS. 1 and 2 an insole according to the invention. Seen is a top member 2 which is in direct contact with the user's foot and must therefore be relatively soft and produce a feeling of comfort. Suitable materials for top member 2 are synthetic rubber or polyorithylene, plastizot or PPT. Top member 2 may also be provided with a top layer for absorbing sweat.

Top member 2 is seated in a bottom member 4, the front portion 6 of which is cemented to top member 2. Bottom member 4 is made of a tough, rigid polymer such as PVC., polypropylene, or the like, as it must support the shock-absorbing unit 8, to be described in detail further below.

Also seen is a window-like opening 10 in a rim portion 11 of bottom member 4 (see also FIG. 3), through which the customized shock-absorbing unit 8 is introduced into the insole.

Figure 4:
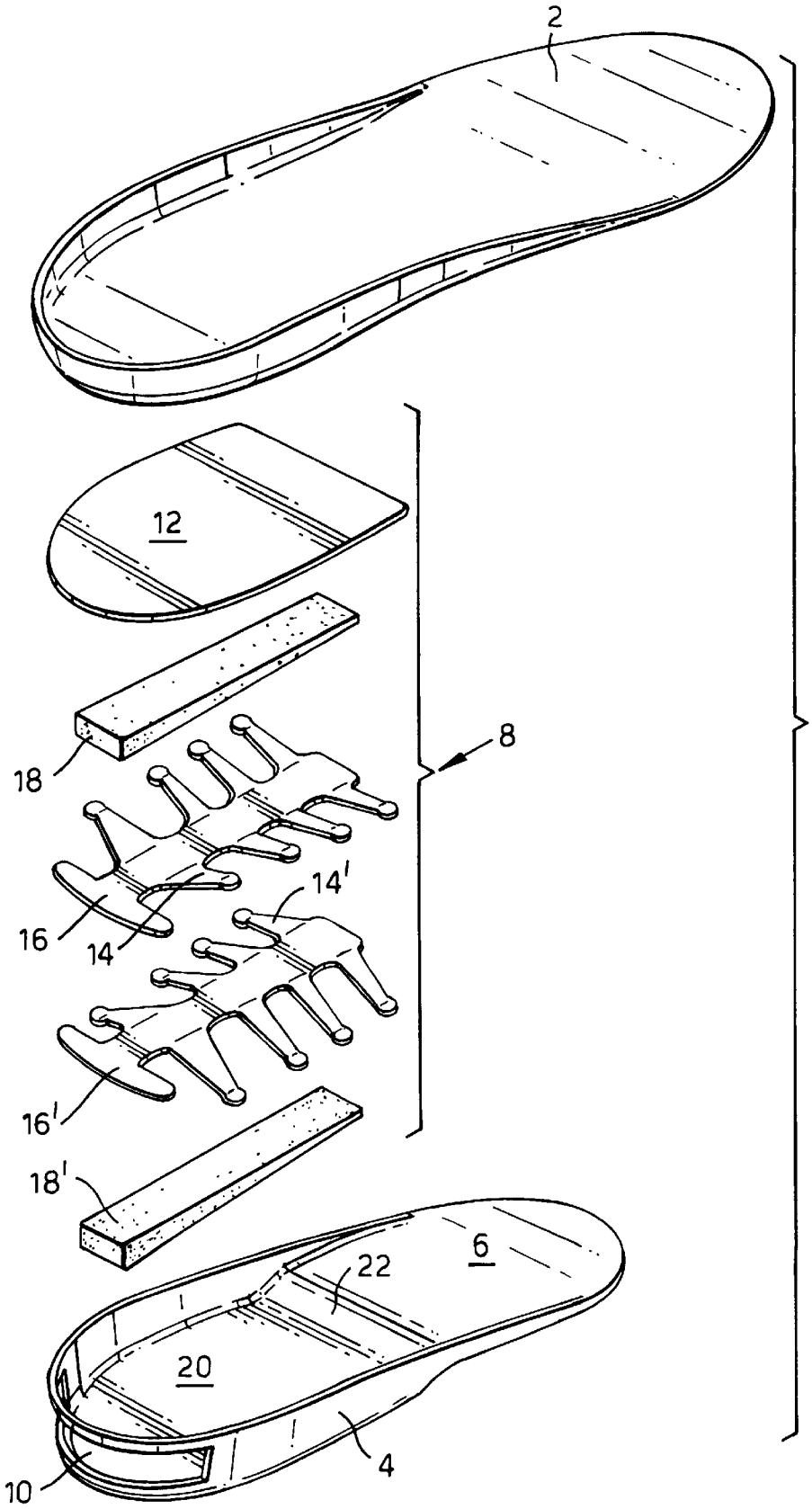

FIG. 4 represents an exploded perspective view of a preferred embodiment of the insole according to the invention. Apart from top member 2 and bottom member 4, there is shown a shock-absorbing unit 8, the presence of which was already indicated in FIGS. 1 and 2 and which is seen to comprise the following components: a top plate 12 made of a tough and rigid material, the purpose of which is to distribute the impact produced by the user's foot over a plurality of elastically deformable elements 14 of the two effective members 16, several embodiments of which will be detailed further below, and two wedge-like pads 18, 18'. Pad 18 is located between top plate 12 and the upper effective member 16; the other pad 18' is located between lower effective member 16' and heel portion 20 of bottom member 4. Pads 18, 18' serve to prevent the collapse of top plate 12 and to stabilize the shock-absorbing unit 8. In assembly, pads 18, 18' extend along, and are cemented to, the plane central portions of effective members 16, 16', respectively. Top plate 12 is cemented to upper pad 18, and the two effective members 16 are cemented back-to-back to one another (see FIG. 5). The shock-absorbing unit 8 is thus turned into a cohesive packet that is easily introduced through window-like opening 10 in bottom member 4, with step 22 in bottom member 4 serving as a locating stop.

Figure 5:
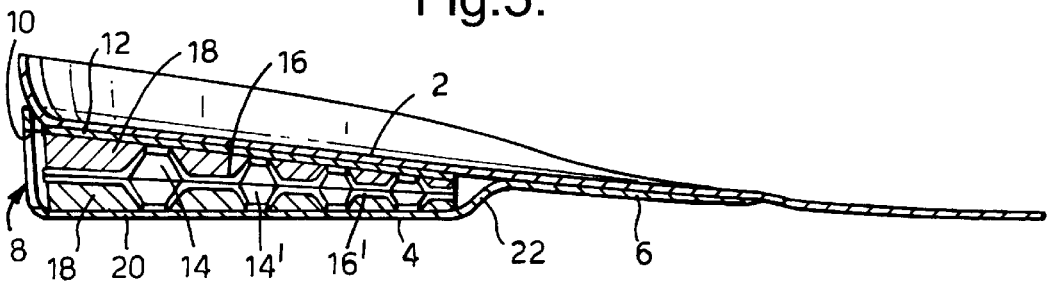

FIG. 5 is a cross-sectional view of the preferred embodiment represented in the exploded view of FIG. 4. There are seen the top member 2, the bottom member 4 and between them, introduced through opening 10, the coherent assembly of shock-absorbing unit 8. The latter is seen to comprise top plate 12, upper pad 18, effective member 16 with its elastically deformable elements 14 upwardly inclined and contacting top plate 12, and effective member 16' with its elements 14' slanting downwardly and resting against heel portion 20 of bottom member 4.

Figure 6:
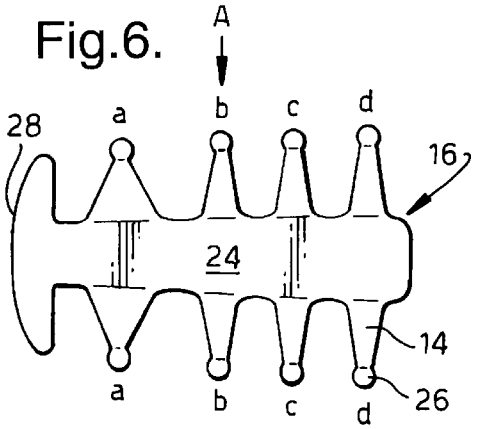
Figure 7:
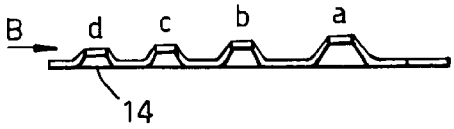
Figure 8:
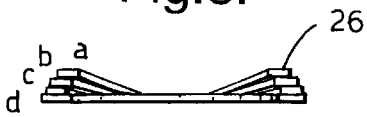
Figure 9:
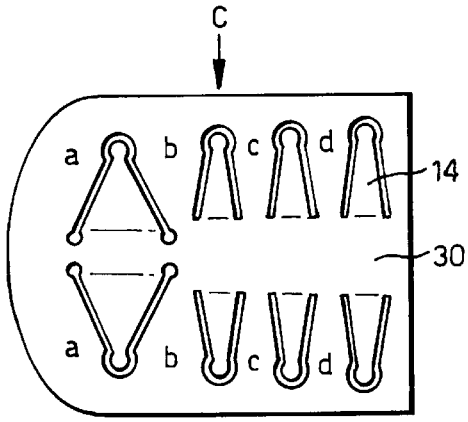
Figure 10:
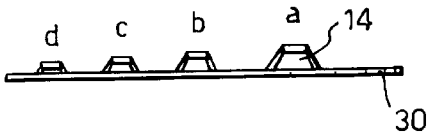

FIGS. 6 to 8 illustrate a first embodiment of effective member 16, which is seen to consist of a substantially plane spine portion 24 a four pairs aa, bb, cc and dd of tongue-like, elastically deformable, flat spring elements 14 branching out from spine portion 24 and rising upwardly from the plane portion 24 to their tips 26 which, as can be seen in FIG. 8, are located in planes that are substantially parallel to the plane of spine portion 24. FIGS. 7 and 8 also indicate that the angle of inclination of elements 14 with respect to the plane of spine portion 24 is the largest with elements 14a and diminishes progressively with elements 14*b* to 14*d*.

It is further seen that the pair aa of spring elements 14, i.e., the pair which is nearest to the heel end 28 of effective member 16, is shorter and has a broader base than the other pairs and is therefore much stiffer, taking into account the fact that when the user's foot makes contact with the ground, it is the heel portion that absorbs most of the primary impact. After that, the foot imparts progressively weaker impacts and smaller elastic deformations to pairs bb, cc and dd.

The decisive advantage of flat-spring elements over cylindrical spring elements is thus obvious: flat springs have no solid height in the above-discussed sense; they can be loaded until they are substantially flush with their base.

Effective member 16 can be manufactured from a variety of materials, such as carbon spring steels, stainless spring steels, alloyed steels, copper, beryllium alloys, etc., each with its own mechanical characteristics such as moduli of elasticity, fatigue strength, etc. This, and the simplicity of the design of the insole according to the invention, make it possible to customize insoles, taking into account the relevant physical characteristics of the user such as his weight, as well as the principal uses of the footwear for which the insoles are intended, such as walking, marching, jogging, running, etc. Moreover, it is possible to design shock-absorbing units 8 (FIG. 4) for specific orthopedically corrective or therapeutic purposes, by modifying the stiffness of one or more spring elements 14.

Figure 3:
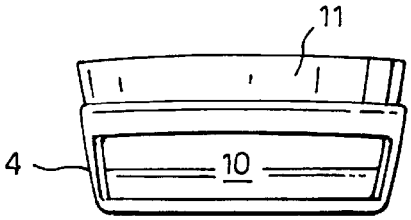

The customizing possibilities of the insole according to the invention are enhanced by the above-described cohesive packet feature of shock-absorbing unit 8, which can be selected from stock or rapidly prepared to fit any demand, to be introduced into an appropriately sized top member 2 and bottom member 4 through the window-like opening 10 (FIGS. 1 to 3).

Another embodiment of effective member 16 is illustrated in FIG. 8. In this embodiment, spring elements 14 do not branch out from a central spine 24 as in FIG. 6, but, e.g., using a laser tool or by stamping, are cut free and raised from a base plate 30. As with the effective member 16 of FIG. 6, spring elements 14 are raised to different heights, with pair aa being imparted the steepest inclination and bb, cc and dd being raised to progressively smaller inclinations. Tips 26 are maintained in a plane substantially parallel to the plane of base plate 30, as in the embodiment of FIG. 6.

Figure 11:
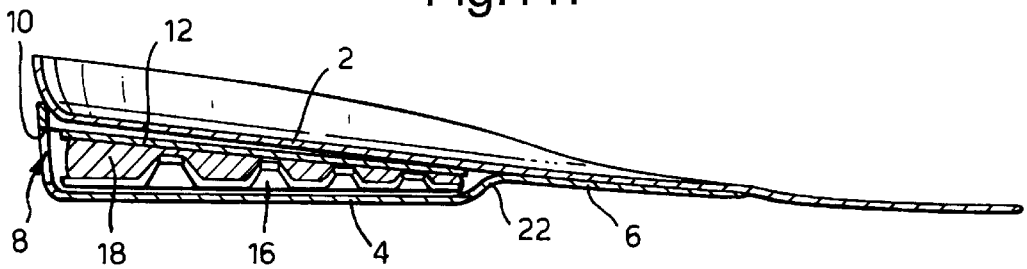

FIG. 11 represents a more slender insole having only one effective member 16, for use in elegant shoes.

It is obviously possible to provide more than the four pairs of spring elements 14 shown in FIGS. 6–10.

It is furthermore understood that the shock-absorbing unit according to the invention may have more than two effective members.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A shock-absorbing insole for footwear, comprising:

a top member adapted to be in contact with the user's foot;

a bottom member partly connected to said top member and adapted to rest on an inside sole of a piece of footwear, and defining a space with a heel portion of said top member;

a shock-absorbing unit comprising, in superposition, a top plate, at least one rubber pad and at least one member provided with a plurality of elastically deformable elements;

at least one rubber pad and said at least one member forming a cohesive packet;

wherein said member comprises a substantially planar spine portion and a plurality of pairs of elastically deformable elements branching out from either side of said spine portion and rising upwardly from the plane of said spine portion, defining an angle of inclination.

2. The insole as claimed in claim 1, wherein the angle of inclination of said elements with respect to said plane decreases progressively from one end of said spine to the other.

3. The insole as claimed in claim 1, wherein at least one elastically deformable element of at least one pair of such elements differs in stiffness from other elastically deformable elements.

4. The insole as claimed in claim 1, wherein at least one pair of said elastically deformable elements is of a stiffness exceeding the stiffness of the other pairs of elements.

5. The insole as claimed in claim 1, wherein the two members in said cohesive packet are arranged back-to-back.

6. The insole as claimed in claim 1, wherein said elastically deformable elements comprise substantially flat springs.

7. The insole as claimed in claim 1, wherein said deformable elements have tips that are located in planes substantially parallel to a plane of said spine portion.

* * * * *